US008387627B2

(12) United States Patent
Yeom

(10) Patent No.: US 8,387,627 B2
(45) Date of Patent: Mar. 5, 2013

(54) COMPACT POWDER CASE

(75) Inventor: O Sin Yeom, Hwasung (KR)

(73) Assignee: Elcos America, Inc., Englewood Cliffs, NJ (US)

( * ) Notice: Subject to any disclaimer, the term of this patent is extended or adjusted under 35 U.S.C. 154(b) by 78 days.

(21) Appl. No.: 12/961,198

(22) Filed: Dec. 6, 2010

(65) Prior Publication Data

US 2012/0048294 A1 Mar. 1, 2012

Related U.S. Application Data

(63) Continuation-in-part of application No. 12/868,283, filed on Aug. 25, 2010.

(51) Int. Cl.

| | |
|---|---|
| ***A45D 33/02*** | (2006.01) |
| ***G01F 11/20*** | (2006.01) |
| ***B07B 1/52*** | (2006.01) |

(52) U.S. Cl. ..... 132/307; 132/299; 222/342; 222/241; 209/384

(58) Field of Classification Search ..... 132/298, 132/299, 303, 6, 306, 307; 401/4; 222/80, 222/342, 241; 206/581, 572, 38; 209/379, 209/384, 385

See application file for complete search history.

(56) References Cited

U.S. PATENT DOCUMENTS

| | | | | |
|---|---|---|---|---|
| 1,801,762 | A * | 4/1931 | Brun | 132/307 |
| 2,076,549 | A | 4/1937 | Conner | |
| 6,354,308 | B1 | 3/2002 | Kuk | |
| 7,726,322 | B2 | 6/2010 | Cho | |
| 2008/0178903 | A1 * | 7/2008 | Thorpe et al. | 132/307 |
| 2008/0190444 | A1 * | 8/2008 | Bennett | 132/306 |
| 2008/0264440 | A1 * | 10/2008 | Thorpe | 132/299 |
| 2008/0276956 | A1 * | 11/2008 | Cho | 132/294 |

FOREIGN PATENT DOCUMENTS

| | | |
|---|---|---|
| KR | 20-0159437 | 1/1999 |
| KR | 10-2004-0025254 | 3/2004 |
| KR | 200404009 | * 12/2005 |

* cited by examiner

*Primary Examiner* — Nicholas Lucchesi
*Assistant Examiner* — Niyati D Shah
(74) *Attorney, Agent, or Firm* — The PL Law Group, PLLC

(57) ABSTRACT

A compact powder case includes a top case, a bottom case coupled to the top case to open and close the compact powder case, a mid case housed in the bottom case, a lifter disk coupled to the bottom case by a spring supporting the lifter disk elastically, a container to contain a content, the container detachably attached to the lifter disk, and a grinding member rotatably positioned on the top of the mid case, the grinding member including a grinding cap and a grinding insert coupled to the grinding cap, the grinding insert having an aperture to discharge ground content upwardly and a blade disposed at a lower portion of the aperture to grind the content when the grinding insert rotates, wherein the grinding insert rotates along with the grinding cap and against the container when a user rotates the grinding cap.

11 Claims, 6 Drawing Sheets

COMPACT POWDER CASE

CROSS-REFERENCE TO RELATED APPLICATIONS AND CLAIM OF PRIORITY

This application is a Continuation-in-Part of application Ser. No. 12/868,283 entitled "COSMETICS CASE", filed on Aug. 25, 2010, which claims the benefit of Korean Patent Application No. 10-2009-0117308, filed on Nov. 30, 2009, in the Korean Intellectual Property Office. The disclosures of all of the foregoing applications are incorporated herein in their entirety by reference.

BACKGROUND

1. Field

Exemplary embodiments of the present invention relate to a compact powder case.

2. Description of the Related Art

In general, a cosmetics case such as a powder case is a portable container for accommodating cosmetics for makeup. Women commonly carry a cosmetics case in their bags and use it at a proper time. The cosmetic case is produced in various shapes. When a woman wants to makeup, the woman opens a cover of the cosmetics case by rotating the cover connected to a base case through a hinge and applies contents thereof on a face using a makeup tool such as a puff or a brush.

A conventional cosmetics case includes A conventional cosmetic case includes a cover having a lock protrusion and a hinge protrusion; a base case pivotally connected to the cover; an intermediate case installed in the base case and having a button and a spring; a powder case installed in the intermediate case and supported by the spring for accommodating a solid powder; and a grinding member rotatably installed in a coupling groove of the intermediate case for grinding the surface of the solid powder in the powder case.

However, the conventional cosmetics case has a structure where the intermediate case is fixed to the base case. That is, the intermediate case of the conventional cosmetics case is not separable from the base case. Accordingly, a user is not allowed to refill the contents thereof when the contents are completely consumed. Since a user must buy a new cosmetics case with contents, the user may be dissatisfied.

Since the conventional cosmetic case was produced without considering refill of the contents, the intermediate case has a closed bottom side. Such a structure of the intermediate case increases a manufacturing cost thereof due to material cost increment. Further, the entire cosmetics case must be discarded when the contents thereof are completely consumed.

SUMMARY

An embodiment of the present invention is a compact powder case including a top case, a bottom case coupled to the top case to open and close the compact powder case, a mid case housed in the bottom case, a lifter disk coupled to the bottom case by a spring supporting the lifter disk elastically, a container to contain a content, the container positioned on the lifter disk, and a grinding member rotatably positioned on the top of the mid case, the grinding member including a grinding cap and a grinding insert coupled to the grinding cap, the grinding insert having an aperture to discharge ground content upwardly and a blade disposed at a lower portion of the aperture to grind the content when the grinding insert rotates, wherein the grinding insert rotates along with the grinding cap and against the container when a user rotates the grinding cap.

Another embodiment of the present invention a compact powder case including: a top case; a bottom case coupled to the top case to open and close the compact powder case, the bottom case including a lifter disk assembly guide and an assembly groove; a lifter disk coupled to the bottom case by a spring supporting the lifter disk elastically, the lifter disk including a couple of protrusions and a guide groove formed between the couple of protrusions, the lifter disk assembly guide of the bottom case inserted into the guide groove of the lifter disk; a mid case having a fringe to be positioned at a top of the bottom case when the mid case is housed in the bottom case, an assembly guide groove in which the couple of protrusions of the lifter disk are inserted and a notch positioned in the assembly groove of the bottom case, the notch extended downwardly from the fringe; a container to contain a content, the container detachably attached to the lifter disk; and a grinding member rotatably positioned on the top of the mid case, the grinding member including a grinding cap including a grinding insert rotation prevention protrusion and a grinding insert including a rotation prevention groove to receive the grinding insert rotation prevention protrusion of the grinding cap to rotate along with the grinding cap when the grinding cap rotates, the grinding insert having an aperture to discharge ground content upwardly and a blade disposed at a lower portion of the aperture to grind the content by a rotation when the grinding insert rotates.

In accordance with another embodiment of the present invention, a compact powder case includes a top case formed of acrylonitrile butadiene styrene (ABS); a mirror attached on the inner side of the top case; a bottom case coupled to the top case to open and close the compact powder case, the bottom case including a lifter disk assembly guide and an assembly groove; a lifter disk coupled to the bottom case by a spring supporting the lifter disk elastically, the lifter disk including a couple of protrusions and a guide groove formed between the couple of protrusions, the lifter disk assembly guide of the bottom case inserted into the guide groove of the lifter disk, the lifter disk formed of polypropylene (PP); a mid case having a fringe to be positioned at a top of the bottom case when the mid case is housed in the bottom case, an assembly guide groove in which the couple of protrusions of the lifter disk are inserted and a notch positioned in the assembly groove of the bottom case, the notch extended downwardly from the fringe; a container to contain a content, the container detachably attached to the lifter disk; and a grinding member rotatably positioned on the top of the mid case, the grinding member including: a grinding cap formed of formed of acrylonitrile butadiene styrene (ABS), the grinding cap including a grinding insert rotation prevention protrusion; and a grinding insert formed of polypropylene (PP), the grinding insert including a rotation prevention groove to receive the grinding insert rotation prevention protrusion of the grinding cap to rotate along with the grinding cap when the grinding cap rotates, the grinding insert having an aperture to discharge ground content upwardly and a blade disposed at a lower portion of the aperture to grind the content by a rotation when the grinding insert rotates.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
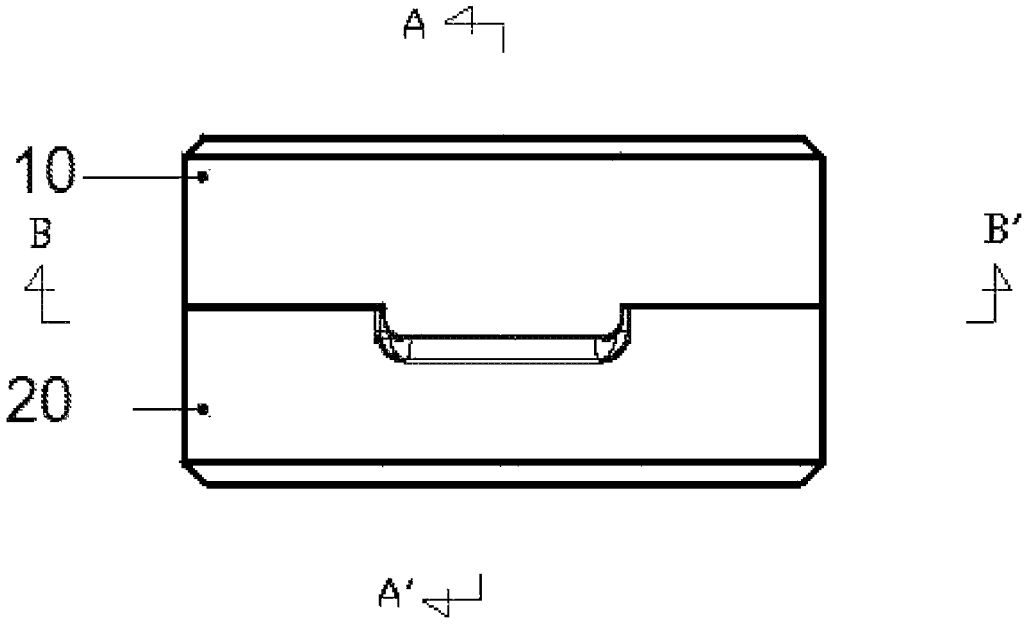
FIG. 1 is a side view of a compact powder case according to an embodiment of the present invention.
Figure 2A:
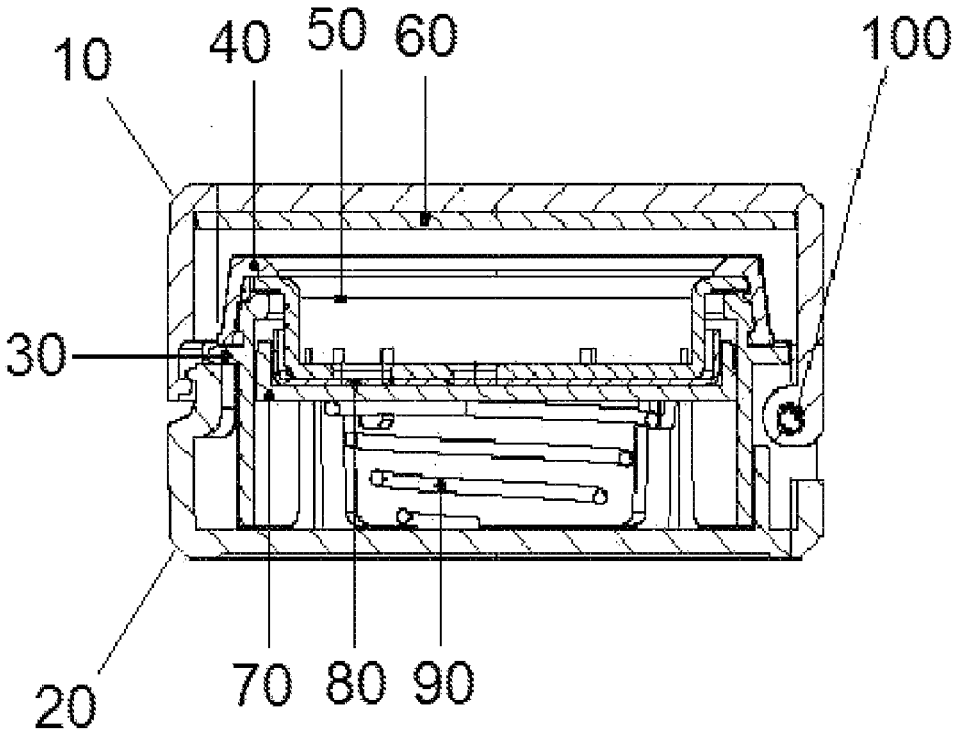
FIG. 2A is a sectional view at line A-A' of the compact powder case shown in FIG. 1.
Figure 2B:
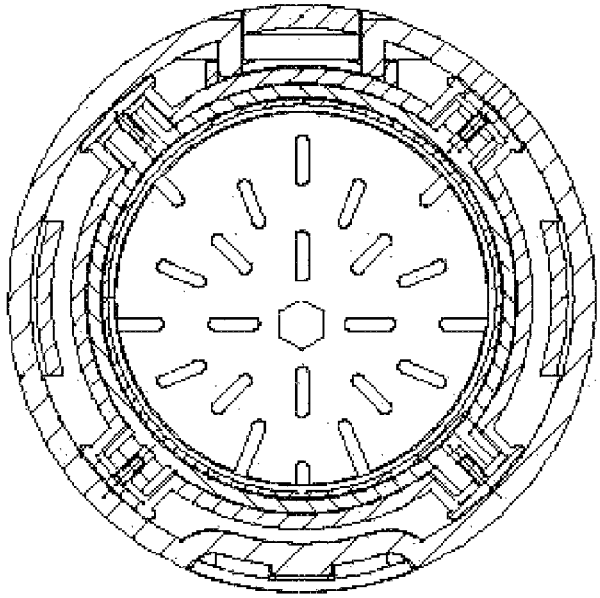
FIG. 2B is a sectional view at line B-B' of the compact powder case shown in FIG. 1 according to an embodiment of the present invention.

Exemplary embodiments of the present invention will be described below in more detail with reference to the accompanying drawings.

According to an embodiment of the present invention, a compact powder case includes a top case, a bottom case coupled to the top case to open and close the compact powder case, a mid case housed in the bottom case, a spring disposed in the bottom case, a lifter disk coupled to the spring supporting the lifter disk elastically, a container to contain a content, the container detachably attached to the lifter disk, and a grinding member rotatably positioned on the top of the bottom case to grind the contents and discharge the ground contents.

Referring to FIGS. 1 to 6, a compact powder case in accordance with an embodiment of the present invention includes a top case 10, a bottom case 20, a mid case 30, a grinding cap 40, a grinding insert 50, optionally a mirror 60, a lifter disk 70, a container 80, a spring 90, and a pin 100.0

The top case 10 may be pivotally connected to a predetermined portion of the bottom case 20. For example, the top case 10 may be connected to the bottom case 20 by a hinge.

Figure 3A:
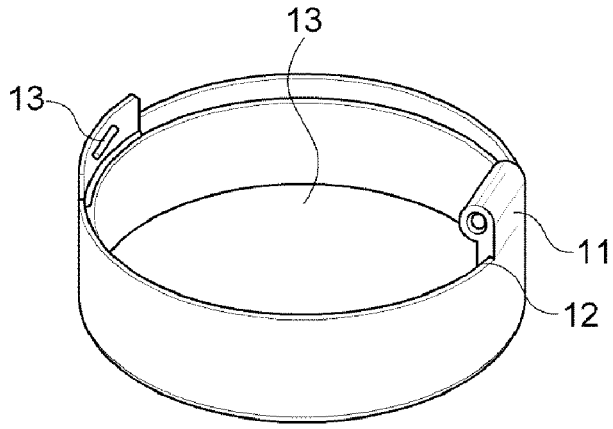
FIGS. 3A through 3C are perspective views of a top case, a grinding cap and a grinding insert of a compact powder case in accordance with an embodiment of the present invention.

Referring to FIG. 3A, the top case 10 may include a protrusion 11 having a hole 12 in which a pin 100 is inserted, an inner surface 13 to which a mirror 60 may be attached, and a stopper 14 to prevent an opening of the top case when the top case 10 is coupled with the bottom case 20.

According to an embodiment of the present invention, the top case 10 may be formed of acrylonitrile butadiene styrene (ABS).

The grinding member may include a grinding cap 40 and a grinding insert 50. The grinding member grinds the contents contained in the container 80 and discharges the ground content upwardly by a rotation motion. The grinding member is rotatably installed in the mid case 30.

Figure 3B:
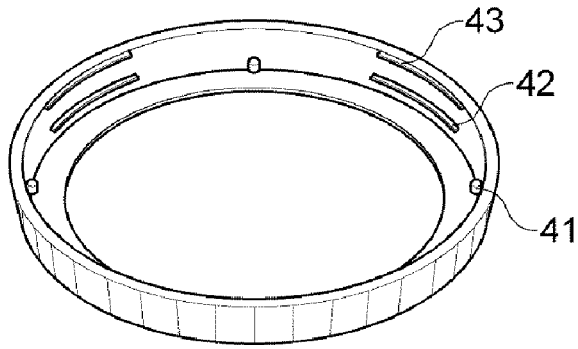

Referring to FIG. 3B, the grinding cap 40 may include a grinding insert rotation prevention protrusion 41 to prevent the grinding insert from rotating against the grinding cap 40 when the grinding cap 40 rotates along with the grinding insert 50, a grinding insert assembly protrusion 42 for being assembled with the grinding insert 50, and a mid case assembly protrusion 43 for being assembled with the mid case 30.

According to an embodiment of the present invention, the grinding cap 40 may be formed of acrylonitrile butadiene styrene (ABS).

Figure 3C:
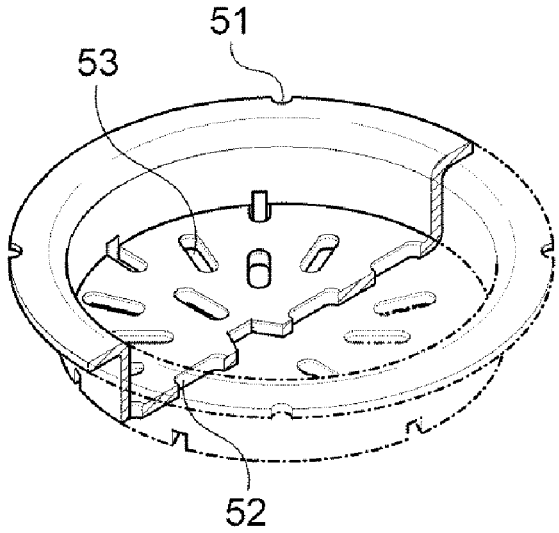

Referring to FIG. 3C, the grinding insert 50 includes a rotation prevention groove 51 to receive the grinding insert rotation prevention protrusion 41 of the grinding cap 40 to make the grinding insert rotate along with the grinding cap, a plurality of apertures 53 for discharging the ground contents, and a plurality of grinding blades 52 disposed at a lower portion of the apertures 53. The grinding blade 52 grinds the contents (a) when the grinding insert 50 rotates. The ground powder is discharged through the apertures 53.

According to an embodiment of the present invention, the grinding insert 50 may be formed of polypropylene (PP).

The lifter disk 70 is coupled to the spring that supports the lifter disk elastically.

Figure 4A:
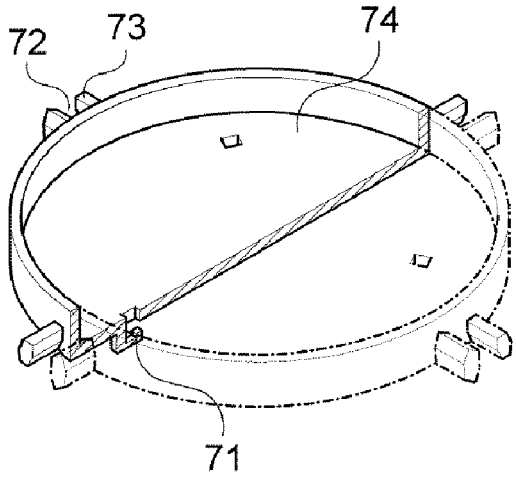
FIGS. 4A through 4C are perspective views of a lifter disk, a mid case and a bottom case of a compact powder case in accordance with an embodiment of the present invention.

Referring to FIG. 4A, the lifter disk 70 includes a spring holder 71 for holding the spring 90, lifter disk protrusions 73 to be coupled to the mid case 30, and a guide groove 72 formed between the lifter disk protrusions 73 to be coupled to the bottom case 20 so that the rotation of the lifter disk 70 may be prevented. The spring holders 71 may be formed at the bottom side of the lifter disk 70 and may be spaced apart at a predetermined gap.

According to an embodiment of the present invention, the lifter disk 70 may be formed of polypropylene (PP).

Figure 4B:
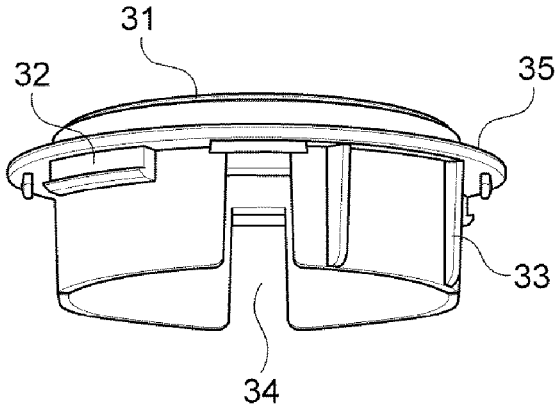
Figure 4C:
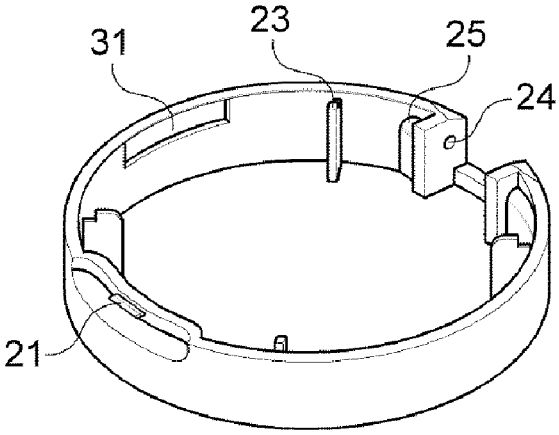
Figure 5B:
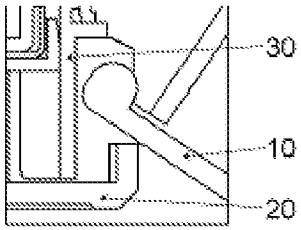
FIGS. 5A through 5D illustrate a partially enlarged views of the portions of "A", "B", "C" and "D", respectively, of FIG. 5.
Figure 5D:
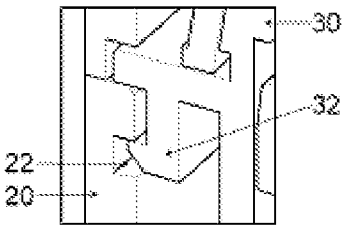
Figure 5:
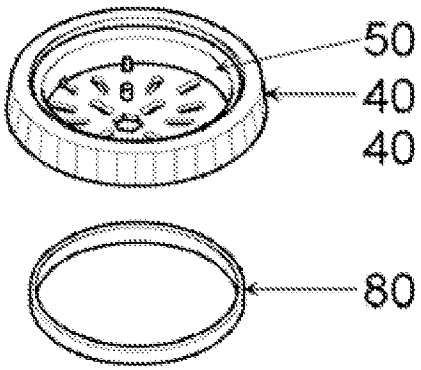
FIG. 5 illustrates a compact powder case in accordance with an embodiment of the present invention.
Figure 5:
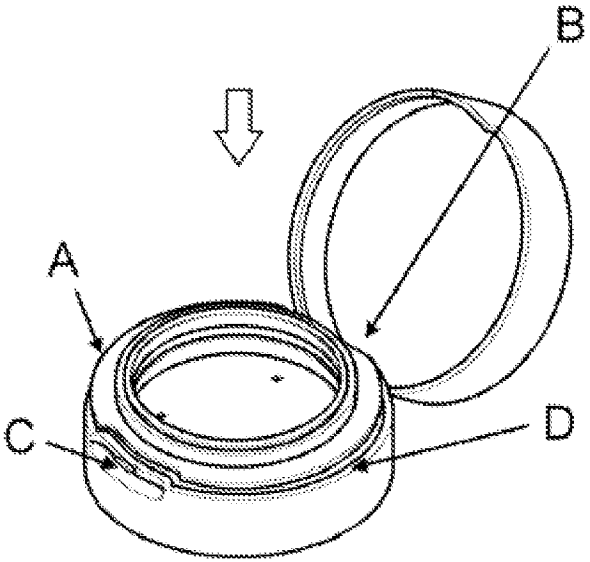
Figure 5A:
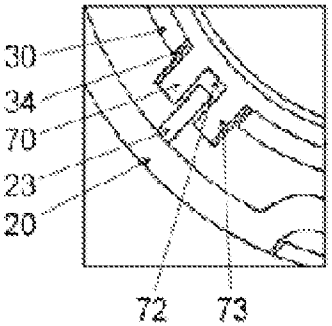
Figure 5C:
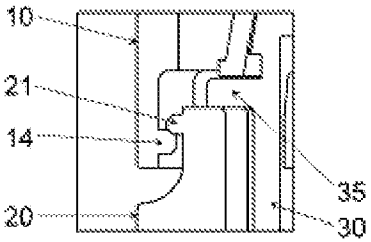
Figure 6E:
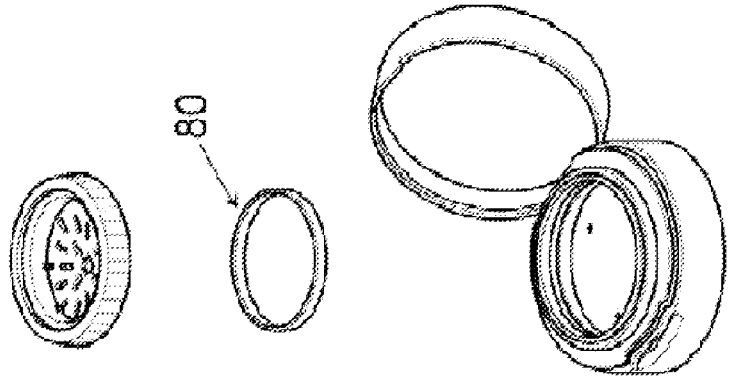
FIGS. 6A through 6E illustrate a method of manufacturing a compact powder case according to an embodiment of the present invention.
Figure 6D:
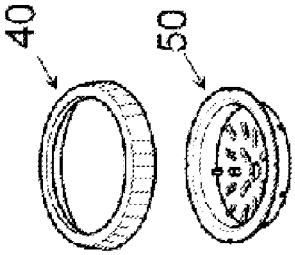
Figure 6C:
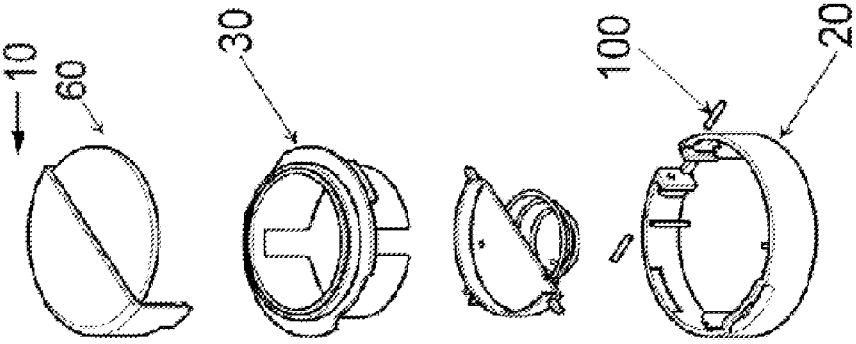
Figure 6A:
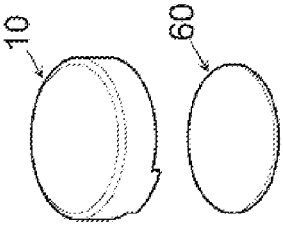
Figure 6B:
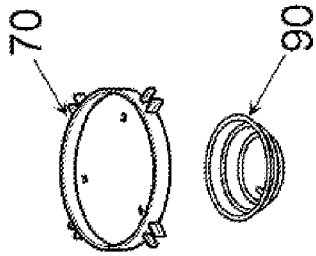

Referring to FIG. 4B, the mid case 30 may include a fringe 35 to be positioned at a top of the bottom case 20 when it is coupled to the bottom case 20, and the mid cover 30 under the fringe 35 is housed in the bottom case 20. A top portion 31 of the mid case 30 is provided to be assembled with the grinding cap 40. A notch 32 extended from the fringe 35 downwardly may be provided to be assembled with the bottom case 20 as shown in FIG. 4B and FIG. 5. The mid case 30 may further include a bottom case assembly guide protrusion 33 to be assembled with the bottom case 20, and an assembly guide groove 34 to receive the lifter disk protrusions 73 of the lifter disk 70.

According to an embodiment of the present invention, the mid case 30 may be formed of acrylonitrile butadiene styrene (ABS).

According to an embodiment of the present invention, the bottom case 20 may include a protrusion 21 to be coupled to the stopper 14 of the top case 10, an assembly groove 22 to receive the notch 32 of the mid case 30, a lifter disk assembly guide 23 to be inserted into the guide groove 72 of the lifter disk 70, a hole 24 in which the pin 100 is inserted. In accordance with this structure, the top case 10 may be pivotally connected to one side of the bottom case 20 by the hinge. The bottom case 20 may further include a mid cover assembly guide 25 to be assembled with the mid cover 30.

According to an embodiment of the present invention, the bottom case 20 may be made of acrylonitrile butadiene styrene (ABS).

Referring to FIG. 5, the A part of FIG. 5 shows how the lifter disk 70 is assembled with the bottom case 20 and the mid case 30. The lifter disk assembly guide 23 is positioned in the guide groove 72 formed between the lifter disk protrusions 73 so that the lifter disk 70 may be prevented from rotating. The lifter disk protrusions 73 are positioned in the assembly guide groove 34 of the mid cover 30. The B part of FIG. 5 shows how the top case 10 is pivotally coupled to the bottom case 20. The C part of FIG. 5 shows a top case close lock. The D part of FIG. 5 shows how the notch 32 of the mid case 30 is coupled to the assembly groove 22 of the bottom case 20.

The container 80 internally stores predetermined contents such as compact powders. The container 80 is positioned on the lifter disk 70 which is elastically supported by the spring 90 coupled at a bottom side of the lifter disk 70. The container

80 may be attached to the lifter disk 70 with a tape such as a double coated tape, or an adhesive. The contents (a) in the container 80 are ground and discharged by the rotation of the grinding insert 50.

According to an embodiment of the present invention, the container 80 may be made of aluminum.

According to an embodiment of the present invention, the container 80 is detachably attached to the lifter disk 70 when the container 80 is attached to the lifter disk 70 by a double coated tape. In the present specification and claims, the A "detachably attached" to B means that A can be detached from B even without a tool. Accordingly, it is possible to refill the contents of the compact powder case by merely detaching the container 80 from the lifter disk 70 when the contents of the compact powder case are consumed completely.

Hereinafter, an exemplary method of manufacturing a compact powder case according to an embodiment of the present invention.

Referring to FIG. 6, the mirror 60 is attached to the inner side of the top case 10. The lifter disk 70 is coupled to the spring 90. The grinding cap 40 is coupled to the grinding insert 50 to provide the grinding member. The mid case 30, and the lifter disk 70 with the spring 90 are housed in the bottom case 20, and the bottom case 20 is pivotally coupled to the top case 10. The container 80 is positioned on the lifter disk, for example, via a double coated tape, and the grinding member is coupled to the mid case.

While the present invention has been described with respect to the specific embodiments, it will be apparent to those skilled in the art that various changes and modifications may be made without departing from the spirit and scope of the invention as defined in the following claims.

What is claimed is:

1. A compact powder case comprising:

a top case;

a bottom case coupled to the top case to open and close the compact powder case;

a mid case housed in the bottom case;

a lifter disk coupled to the bottom case by a spring supporting the lifter disk elastically;

a container to contain a content, the container positioned on the lifter disk; and a grinding member rotatably positioned on a top of the mid case, the grinding member comprising a grinding cap and a grinding insert coupled to the grinding cap, the grinding insert having an aperture to discharge ground content upwardly and a blade disposed at a lower portion of the aperture to grind the content when the grinding insert rotates, wherein the grinding insert rotates along with the grinding cap and against the container when a user rotates the grinding cap;

wherein the mid case has a fringe to be positioned at a top of the bottom case when the mid case is housed in the bottom case;

the lifter disk further includes a couple of protrusions and a guide groove formed between the couple of protrusions;

the mid case further has an assembly guide groove in which the couple of protrusions of the lifter disk are inserted and a notch extended downwardly from the fringe; and the bottom case includes a lifter disk assembly guide to be inserted into the guide groove of the lifter disk and an assembly groove to receive the notch of the mid case.

2. The compact powder case of claim 1, further comprising a mirror attached on an inner side of the top case.

3. The compact powder case of claim 1, wherein the top case includes a stopper, and the bottom case includes a protrusion to be coupled to the stopper of the top case to prevent an opening of the top case when the top case is closed.

4. The compact powder case of claim 1, wherein the top case is formed of acrylonitrile butadiene styrene (ABS).

5. The compact powder case of claim 1, wherein the grinding cap includes a grinding insert rotation prevention protrusion, and the grinding insert includes a rotation prevention groove to receive the grinding insert rotation prevention protrusion of the grinding cap to rotate along with the grinding cap when the grinding cap rotates.

6. The compact powder case of claim 1, wherein the grinding insert is formed of polypropylene (PP), and the grinding cap is formed of acrylonitrile butadiene styrene (ABS).

7. The compact powder case of claim 1, wherein the lifter disk is formed of polypropylene (PP).

8. A compact powder case comprising:

a top case;

a bottom case coupled to the top case to open and close the compact powder case, the bottom case including a lifter disk assembly guide and an assembly groove;

a lifter disk coupled to the bottom case by a spring supporting the lifter disk elastically, the lifter disk including a couple of protrusions and a guide groove formed between the couple of protrusions, the lifter disk assembly guide of the bottom case inserted into the guide groove of the lifter disk;

a mid case having a fringe to be positioned at a top of the bottom case when the mid case is housed in the bottom case, an assembly guide groove in which the couple of protrusions of the lifter disk are inserted and a notch positioned in the assembly groove of the bottom case, the notch extended downwardly from the fringe;

a container to contain a content, the container detachably attached to the lifter disk; and a grinding member rotatably positioned on a top of the mid case, the grinding member comprising:

a grinding cap including a grinding insert rotation prevention protrusion; and a grinding insert including a rotation prevention groove to receive the grinding insert rotation prevention protrusion of the grinding cap to rotate along with the grinding cap when the grinding cap rotates, the grinding insert having an aperture to discharge ground content upwardly and a blade disposed at a lower portion of the aperture to grind the content by a rotation when the grinding insert rotates.

9. The compact powder case of claim 8, further comprising a mirror attached on the inner side of the top case.

10. The compact powder case of claim 8, wherein the top case includes a stopper, and the bottom case includes a protrusion to be coupled to the stopper of the top case to prevent an opening of the top case when the top case is closed.

11. A compact powder case comprising:

a top case formed of acrylonitrile butadiene styrene (ABS);

a mirror attached on the inner side of the top case;

a bottom case coupled to the top case to open and close the compact powder case, the bottom case including a lifter disk assembly guide and an assembly groove;

a lifter disk coupled to the bottom case by a spring supporting the lifter disk elastically, the lifter disk including a couple of protrusions and a guide groove formed between the couple of protrusions, the lifter disk assembly guide of the bottom case inserted into the guide groove of the lifter disk, the lifter disk formed of polypropylene (PP);

a mid case having a fringe to be positioned at a top of the bottom case when the mid case is housed in the bottom case, an assembly guide groove in which the couple of protrusions of the lifter disk are inserted and a notch positioned in the assembly groove of the bottom case, the notch extended downwardly from the fringe;

a container to contain a content, the container detachably attached to the lifter disk; and a grinding member rotatably positioned on a top of the mid case, the grinding member comprising:

a grinding cap formed of acrylonitrile butadiene styrene (ABS), the grinding cap including a grinding insert rotation prevention protrusion; and a grinding insert formed of polypropylene (PP), the grinding insert including a rotation prevention groove to receive the grinding insert rotation prevention protrusion of the grinding cap to rotate along with the grinding cap when the grinding cap rotates, the grinding insert having an aperture to discharge ground content upwardly and a blade disposed at a lower portion of the aperture to grind the content by a rotation when the grinding insert rotates.

* * * * *